US006026524A

United States Patent [19]

Barger

[11] Patent Number: 6,026,524

[45] Date of Patent: Feb. 22, 2000

[54] PLAYYARD WITH ROCKERS

[75] Inventor: Jeffrey A. Barger, Greenville, Ohio

[73] Assignee: Evenflo Company, Inc., Vandalia, Ohio

[21] Appl. No.: 09/177,172

[22] Filed: Oct. 22, 1998

[51] Int. Cl.[7] ..... A47D 9/04

[52] U.S. Cl. ..... 5/93.1; 5/105; 5/107; 5/108

[58] Field of Search ..... 5/93.1, 105, 106, 5/107, 108, 101; 297/133, 258.1, 272.1

[56] References Cited

U.S. PATENT DOCUMENTS

| | | | |
|---|---|---|---|
| Re. 9,596 | 3/1881 | Brolaski . | |
| 113,497 | 4/1871 | Charlton | 5/93.1 X |
| D. 281,745 | 12/1985 | Pandorf et al. | D6/390 |
| 394,010 | 12/1888 | Powers . | |
| 490,952 | 1/1893 | Eckert . | |
| 813,521 | 2/1906 | Reilly | 5/93.1 X |
| 1,016,579 | 2/1912 | Poulnot . | |
| 2,106,927 | 2/1938 | Kinnear | 5/106 |
| 2,452,838 | 11/1948 | Come | 5/106 X |
| 2,688,997 | 9/1954 | Miller | 5/105 X |
| 3,090,634 | 5/1963 | Hesketh et al. . | |
| 3,158,877 | 12/1964 | Cooper | 5/105 |
| 3,336,608 | 8/1967 | Lerner . | |
| 4,891,852 | 1/1990 | Lopez, Jr. | 5/105 |
| 5,016,301 | 5/1991 | Combs | 5/105 |
| 5,271,107 | 12/1993 | Gof et al. | 4/572 |

*Primary Examiner*—Terry Lee Melius
*Assistant Examiner*—Fredrick Conley
*Attorney, Agent, or Firm*—Thompson Hine & Flory LLP

[57] ABSTRACT

A playyard system adapted to be used in a conventional fixed mode or as a rocker including a playyard in a generally rectilinear configuration.

4 Claims, 4 Drawing Sheets

PLAYYARD WITH ROCKERS

BACKGROUND OF THE INVENTION

1. Field of the Invention

The present invention relates to a playyard system adapted to be used in a conventional fixed mode or as a rocker and, more particularly, pertains to converting a playyard between a rocker mode and a conventional fixed mode at the discretion of a child care provider.

2. Description of the Prior Art

The use of playyards and rockers of known designs and configurations is known in the prior art. More specifically, playyards and rockers of known designs and configurations heretofore devised and utilized for the purpose of converting child care products among various functional modes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,891,852 to Lopez, Jr. discloses a bassinet rocker. U.S. Pat. No. 5,016,302 to Combs discloses an infant rocker/cradle. U.S. Pat. No. 5,271,107 to Gof et al discloses an infant bathing and crib device. Lastly, U.S. Pat. No. Des. 281,745 to Pandorf et al discloses the ornamental design for a crib.

While these devices fulfill their respective, particular objectives and requirements, the aforementioned patents do not describe a playyard system adapted to be used in a conventional fixed mode or as a rocker that allows converting a playyard between a rocker mode and a conventional fixed mode at the discretion of a child care provider.

In this respect, the playyard system adapted to be used in a conventional fixed mode or as a rocker according to the present invention substantially departs from the conventional concepts and designs of the prior art, and in doing so provides an apparatus primarily developed for the purpose of converting a playyard between a rocker mode and a conventional fixed mode at the discretion of a child care provider.

Therefore, it can be appreciated that there exists a continuing need for a new and improved playyard system adapted to be used in a conventional fixed mode or as a rocker which can be used for converting a playyard between a rocker mode and a conventional fixed mode at the discretion of a child care provider. In this regard, the present invention substantially fulfills this need.

SUMMARY OF THE INVENTION

In view of the foregoing disadvantages inherent in the known types of playyards and rockers of known designs and configurations now present in the prior art, the present invention provides an improved playyard system adapted to be used in a conventional fixed mode or as a rocker. As such, the general purpose of the present invention, which will be described subsequently in greater detail, is to provide a new and improved playyard system adapted to be used in a conventional fixed mode or as a rocker and method which has all the advantages of the prior art and none of the disadvantages.

To attain this, the present invention essentially comprises a playyard system to be used in a conventionally fixed mode or as a rocker, at the discretion of a child care provider, comprising in combination, a playyard in a generally rectilinear configuration. The playyard has a closed bottom with a floor, an open top, and two generally rectangular side walls. The front end wall and rear end wall are generally rectangular.

A leg extends downwardly from each of the lower corners of the playyard. The legs function to hold the playyard in a fixed mode. A pair of wheels are located beneath one of the end walls of the playyard. The wheels are provided for transportation purposes. Next provided are a pair of rockers. Each rocker member is located beneath an associated end wall. Each rocker has a generally linear horizontal end extent which constitutes a minority of the extent of the rocker. An elongated central extent in an arcuate configuration is located therebetween. Linear extender extents are located between the end extents and the central extent with a length whereby the central extent may extend downwardly to a distance greater than the lower most extents of the legs. An arcuate elastomeric tube encompasses the majority of the extent of each central portion for contacting the ground when deployed so as to promote rocking of the playyard. Next provided is a generally tubular adapter. The adapter is integrally formed with each leg and arranged in pairs. One pair is located beneath one end wall and the other beneath the other end wall. Each pair has facing tubular openings. The openings function to receive an associated end extent of a rocker rod. Each adapter extends arcuately for slightly greater than 180 degrees with an open bottom. Each adapter has a pair of generally rectilinear recesses. The recesses are located adjacent to the adapter's interior edge. One recess is located near the top of the tubular opening offset toward the center to a limited extent. The other recess extends laterally from the center for nearly 90 degrees from the top of the tubular opening. Next provided is a spring-urged ball. The ball extends outwardly from each end portion of each tube oppositely from the arcuate extent. The ball is adapted to be received in the first recesses. The spring-urged ball functions to hold the rockers downwardly for deploying the playyard in a rocking mode. Each spring-urged ball is adapted to be received in the second recesses with the bar retracted toward the center of the playyard with the legs in contact with the ground. In this position, the playyard system is deployed in a fixed mode.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved playyard system adapted to be used in a conventional fixed mode or as a rocker which has all of the advantages of the prior art playyards and rockers of known designs and configurations and none of the disadvantages.

It is another object of the present invention to provide a new and improved playyard system adapted to be used in a conventional fixed mode or as a rocker which may be easily and efficiently manufactured and marketed.

It is further object of the present invention to provide a new and improved playyard system adapted to be used in a conventional fixed mode or as a rocker which is of durable and reliable constructions.

An even further object of the present invention is to provide a new and improved playyard system adapted to be used in a conventional fixed mode or as a rocker which is susceptible of a low cost of manufacture with regard to both materials and labor, and which accordingly is then susceptible of low prices of sale to the consuming public, thereby making such playyard system adapted to be used in a conventional fixed mode or as a rocker economically available to the buying public.

Even still another object of the present invention is to provide a playyard system adapted to be used in a conventional fixed mode or as a rocker for converting a playyard between a rocker mode and a conventional fixed mode at the discretion of a child care provider.

Lastly, it is an object of the present invention to provide a new and improved playyard in a generally rectilinear configuration having a closed bottom with a floor, an open top and two generally rectangular side walls and a generally rectangular front end wall and a rear end wall. A leg extends extending downwardly from each of the lower corners of the playyard for holding the playyard in a fixed mode. A pair of rockers, each rocker member being located beneath an associated end wall and having a generally linear horizontal end extent constituting a minority of the extent of the rocker, an elongated central extent in an arcuate configuration therebetween, a generally tubular adapter integrally formed with each leg and arranged in pairs, one pair beneath one end wall and the other beneath the other end wall, each pair having facing tubular openings receiving an associated end extent of a rocker rod. Each adapter has a pair of generally rectilinear recesses adjacent to its interior edge, one recess near the top of the tubular opening offset toward the center to a limited extent and the other recess extending laterally from the center for nearly 90 degrees from the top of the tubular opening. A movable locker extends outwardly from each end portion of each tube oppositely from the arcuate extent adapted to be received in the first recesses to hold the rockers downwardly for deploying the playyard in a rocking mode and each movable locker adapted to be received in the second recesses with the bar retracted toward the center of the playyard with the legs in contact with the ground for deployment in a fixed mode.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
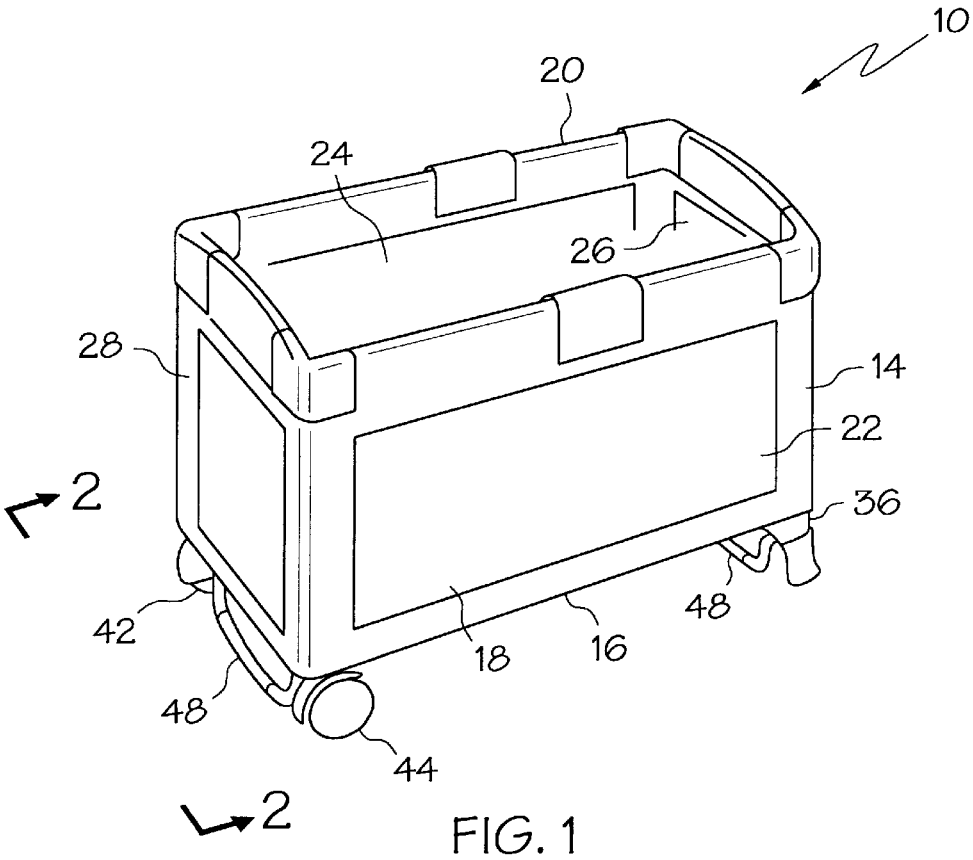
FIG. 1 is a perspective view of the new and improved play yard with rockers constructed in accordance with the principles of the present invention.
Figure 2:
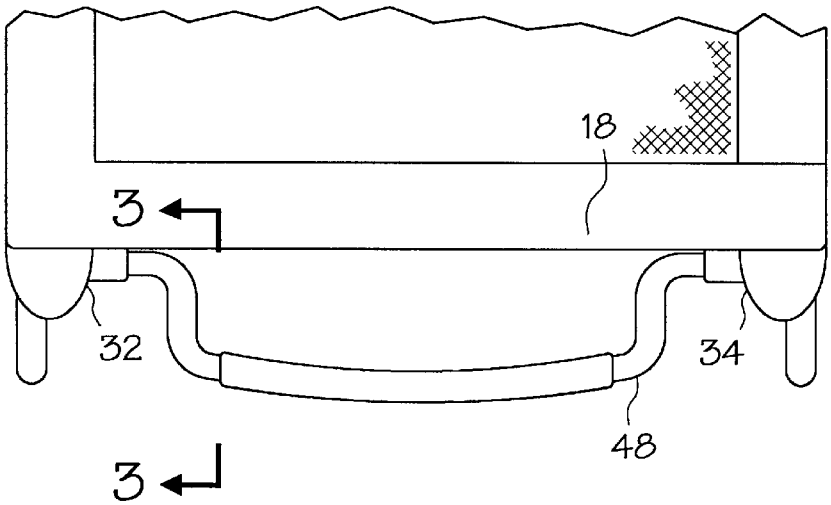
FIG. 2 is an end view of the lower portion of a playyard system taken along line 2—2 of FIG. 1.
Figure 3:
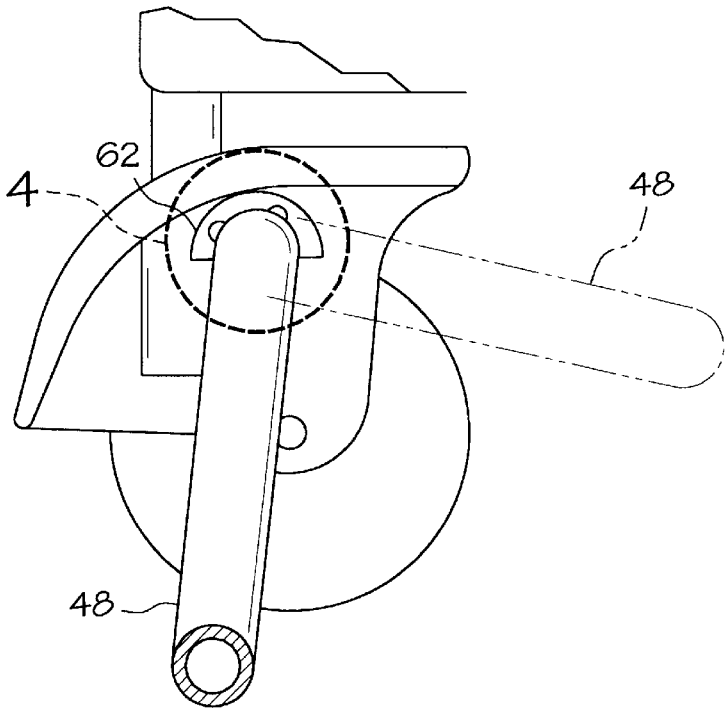
FIG. 3 is a cross-sectional view taken along line 3—3 of FIG. 2.
Figure 4:
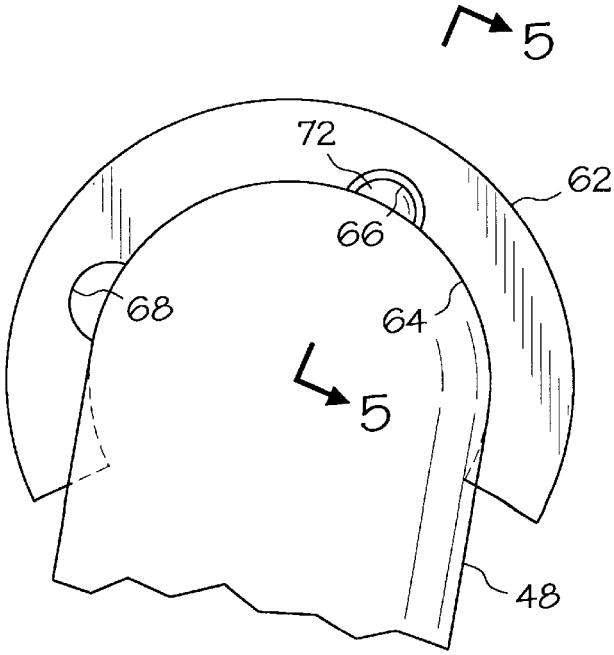
FIG. 4 is a cross-sectional view taken along line 4—4 of FIG. 3.
Figure 5:
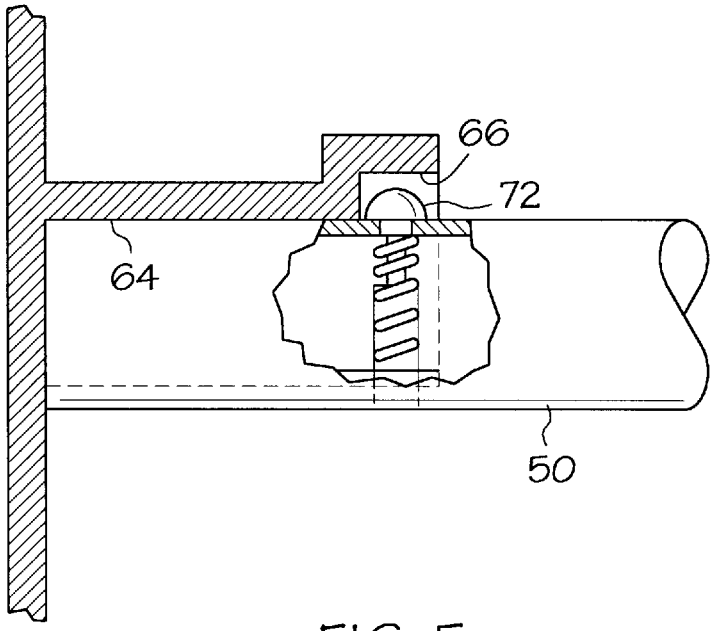
FIG. 5 is a cross-sectional view taken along line 5—5 of FIG. 4.
Figure 6:
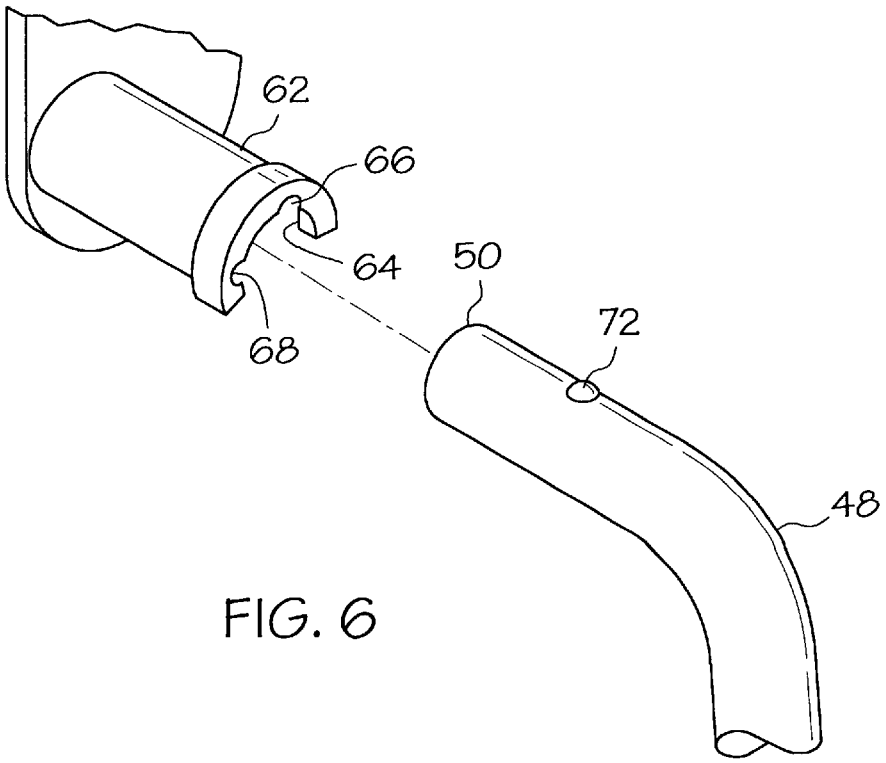
FIG. 6 is an exploded perspective view of the coupling between the rocker and its associated adapter.
Figure 7:
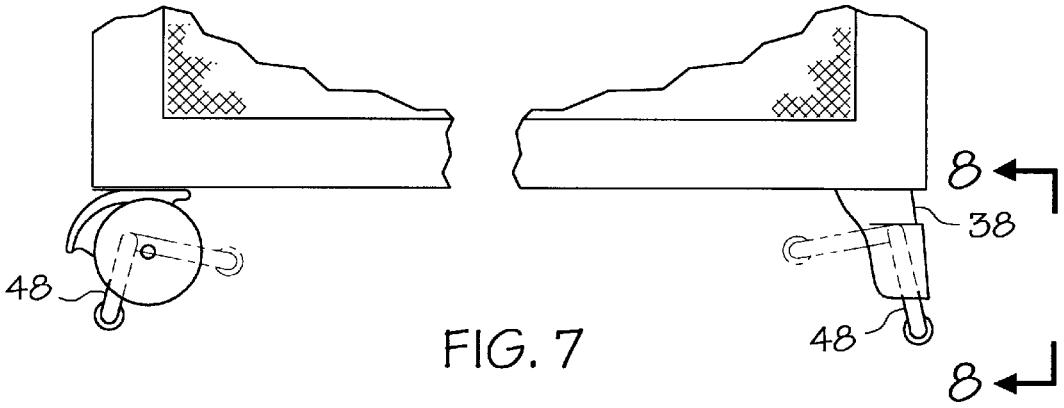
FIG. 7 is a side elevational view of the lower portion of the playyard of FIGS. 1 and 2 illustrating the two positions of the rocker.
Figure 8:
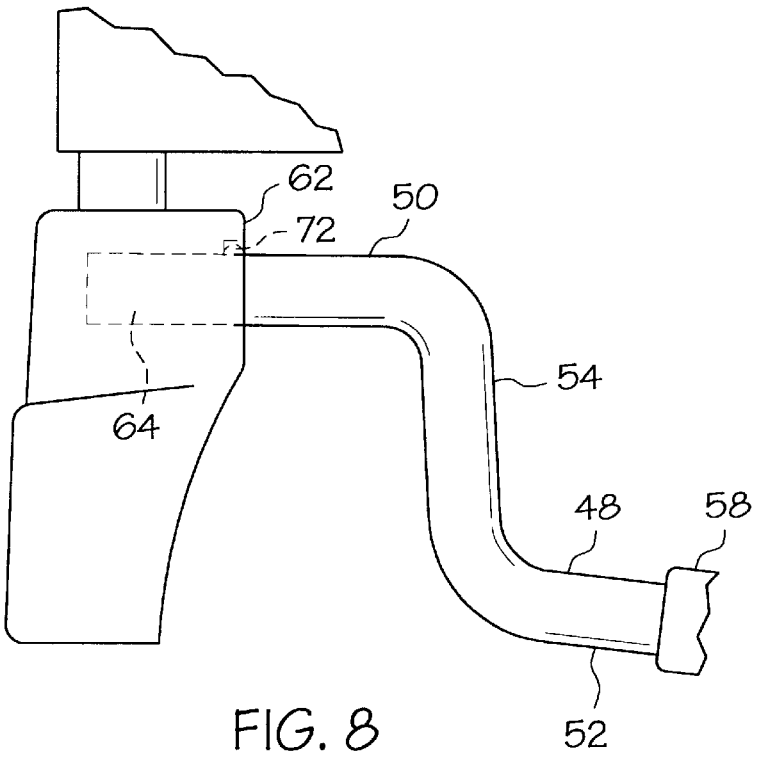
FIG. 8 is an end elevational view taken along line 8—8 of FIG. 7.

With reference now to the drawings, and in particular to FIG. 1 thereof, the preferred embodiment of the new and improved playyard system adapted to be used in a conventional fixed mode or as a rocker embodying the principles and concepts of the present invention and generally designated by the reference numeral 10 will be described.

The present invention, the playyard system with rockers 10, is comprised of a plurality of components. Such components in their broadest context include a playyard, downwardly extending legs, a pair of wheels, a pair of rockers, an arcuate elastomeric tube, tubular adapters, and spring-urged balls. Such components are individually configured and correlated with respect to each other so as to attain the desired objective.

The playyard system 10 is adapted to be used in a conventionally fixed mode or as a rocker, at the discretion of a child care provider. The system comprises, in combination, a playyard 14 in a generally rectilinear configuration. It has a closed bottom 16 with a floor 18, an open top 20, and two generally rectangular side walls 22, 24. It also has a generally rectangular front end wall 26 and a rear end wall 28.

A leg 32, 34, 36, 38 extends downwardly from each of the lower corners of the playyard. The legs function to hold the playyard in a fixed mode.

A pair of wheels 42, 44 are preferably located beneath one of the end walls of the playyard. The wheels assist in transportation purposes.

A pair of similarly configured rockers 48 are next provided. Each rocker is located beneath an associated end wall. Each rocker has opposed generally linear horizontal end extents 50 constituting a minority of the extent of the rocker. Each also has an elongated central extent 52 in an arcuate configuration between the end extents. Linear extender extents 54 are located between the end extents and the central extent. The extender extents are of a length whereby the central extent may extend downwardly to a distance greater than the lowermost extents of the legs.

An arcuate elastomeric tube 58 encompasses the majority of the extent of each central extent. Such tubes function for contacting the ground when deployed as a rocker so as to promote rocking of the playyard.

A generally tubular adapter 62 is integrally formed with each leg. The adapters are arranged in pairs. One pair is beneath one end wall and the other pair is beneath the other end wall. Each pair has facing tubular openings 64. Such openings receive an associated end extent of a rocker rod. Each adapter extends arcuately for slightly greater than 180 degrees with an open bottom. Each adapter also has a pair of generally semi-circular recesses 66, 68 adjacent to its interior edge. One recess 66 is near the top of the tubular opening offset toward the center to a limited extent. The other recess 68 extends laterally from the center for nearly 90 degrees from the to of the tubular opening.

A spring-urged ball 72 extends outwardly from each end portion of each tube. The balls extend in a direction oppositely from the arcuate extent. The balls are adapted to be received in the first recesses 66 to hold the rockers downwardly for deploying the playyard in a rocking mode. Each spring-urged ball is selectively adapted to be received in the second recesses 68 with the bar retracted toward the center of the playyard with the legs in contact with the ground for deployment in a fixed mode.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A playyard system to be used in a conventionally fixed mode or as a rocker comprising in combination:

a playyard in a generally rectilinear configuration having a closed bottom with a floor, an open top, and two generally rectangular side walls and a generally rectangular front end wall and a rear end wall, all of the walls and the floor meeting to form lower corners;

a leg extending downwardly from each of the lower corners of the playyard for holding the playyard in a fixed mode;

a pair of wheels located beneath at least one of the front end wall or rear end wall of the playyard for transportation purposes;

a pair of rocker members, each rocker member being located beneath an associated end wall, each rocker member having two generally linear horizontal end portions constituting a minority of the whole of the rocker member, an elongated central portion in an arcuate configuration between the end portions and two linear extender portions positioned between the linear horizontal end portions and the elongated central portion of the rocker member, the linear extender portions having a length whereby the elongated central portion may extend downwardly to a distance greater than a lower most extent of the legs;

an arcuate elastomeric tube encompassing a majority of the elongated central portion of each rocker member for contacting a ground surface;

generally tubular adapters positioned in proximity to each leg, the adapters having facing tubular openings for receiving an associated end extent of the rocker members, whereby the adapters extend arcuately for slightly greater than 180 degrees and include open bottom openings, the adapters each adapter including a pair of recesses positioned adjacent to an interior edge of the tubular openings of the adapters;

a spring-urged ball extending outwardly from an end portion of each rocker member, the spring-urged ball adapted to be received in the recesses of the adapters to hold the rocker members downwardly for deploying the playyard in a rocking mode and upwardly for deployment of the playyard in a fixed mode.

2. A playyard comprising:

a generally rectilinear structure having a closed bottom with a floor, an open top, and two generally rectangular side walls and a generally rectangular front end wall and a rear end wall, all of the walls and the floor meeting to form lower corners;

a leg extending downwardly from each of the lower corners of the playyard for holding the playyard in a fixed mode;

a pair of rocker members, each rocker member being located beneath an associated end wall, each rocker member having generally linear horizontal end portions constituting a minority of the whole of the rocker member, and each rocker member having an elongated central portion in an arcuate configuration between the linear horizontal end portions;

generally tubular adapters positioned in proximity to each leg, the adapters having facing tubular openings for receiving an associated end of a rocker member, the adapters each including having a pair of recesses adjacent to an interior edge of the adapters;

a movable locker extending outwardly from an end portion of each rocker member, the movable locker adapted to be received in the recesses of the adapters to hold the rocker members downwardly for deploying the playyard in a rocking mode and upwardly for deployment in a fixed mode.

3. The playyard as set forth in claim 2 and further including:

a pair of wheels located beneath at least one of the front end walls or rear end walls of the playyard for transportation purposes.

4. The playyard as set forth in claim 2 and further including:

an arcuate elastomeric tube encompassing a majority of the elongated central portion of each rocker member.

* * * * *